US008112946B2

(12) United States Patent
Vogt

(10) Patent No.: US 8,112,946 B2
(45) Date of Patent: Feb. 14, 2012

(54) ARTICULATING MAST

(75) Inventor: Dewayne G. Vogt, Tulsa, OK (US)

(73) Assignee: Woolslayer Companies, Inc., Tulsa, OK (US)

( * ) Notice: Subject to any disclaimer, the term of this patent is extended or adjusted under 35 U.S.C. 154(b) by 317 days.

(21) Appl. No.: 12/624,128

(22) Filed: Nov. 23, 2009

(65) Prior Publication Data

US 2011/0120043 A1 May 26, 2011

(51) Int. Cl.
*B66C 23/06* (2006.01)

(52) U.S. Cl. ..... 52/116; 52/646

(58) Field of Classification Search ..... 52/116, 52/117, 112, 651.01, 637, 645, 646
See application file for complete search history.

(56) References Cited

U.S. PATENT DOCUMENTS 3,352,070 A * 11/1967 Raynes ..... 52/22
3,477,235 A 11/1969 Branham et al.
3,835,612 A * 9/1974 Beziat ..... 52/638
4,042,123 A 8/1977 Sheldon et al.
4,269,554 A 5/1981 Jackson
4,290,495 A 9/1981 Elliston
4,651,884 A 3/1987 Kennard, Jr. et al.
4,725,179 A 2/1988 Woolslayer et al.
4,848,697 A 7/1989 Skalleberg
5,540,540 A 7/1996 Peterson
6,113,338 A 9/2000 Smith
6,430,887 B1 8/2002 Daudet
6,481,931 B1 11/2002 Welsh
6,591,471 B1 7/2003 Hollingsworth et al.
6,594,960 B2 7/2003 Brittain et al.
6,821,071 B2 11/2004 Woolslayer et al.
6,910,679 B1 6/2005 Vogt et al.
7,469,513 B2 * 12/2008 Schipani et al. ..... 52/648.1

* cited by examiner

*Primary Examiner* — Basil Katcheves
(74) *Attorney, Agent, or Firm* — Head, Johnson & Kachigian, P.C.

(57) ABSTRACT

The present invention relates to an articulating mast having sections that may be moved between an open, in-use position and a more compact reduced width configuration for storage and transportation.

18 Claims, 5 Drawing Sheets

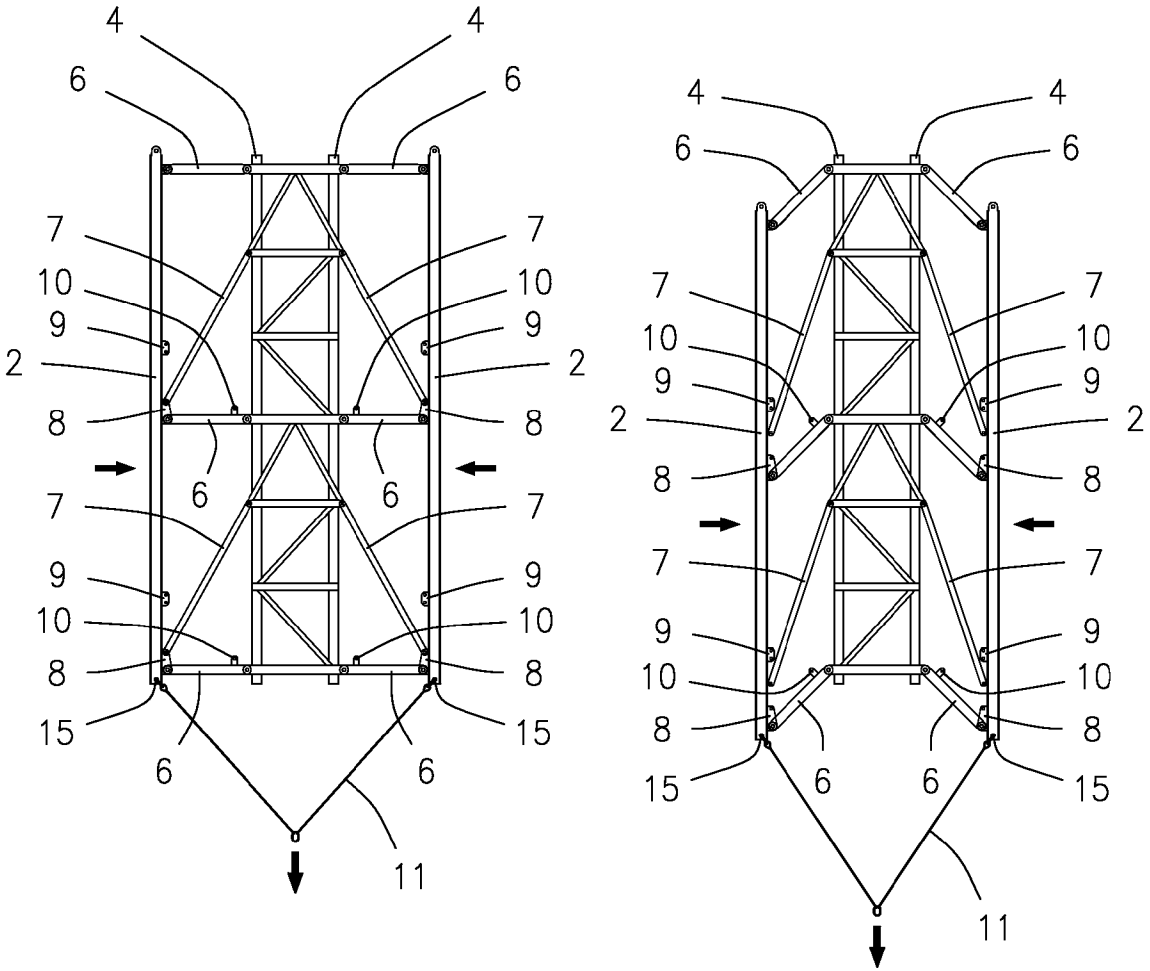
FIG. 6A
FIG. 6B
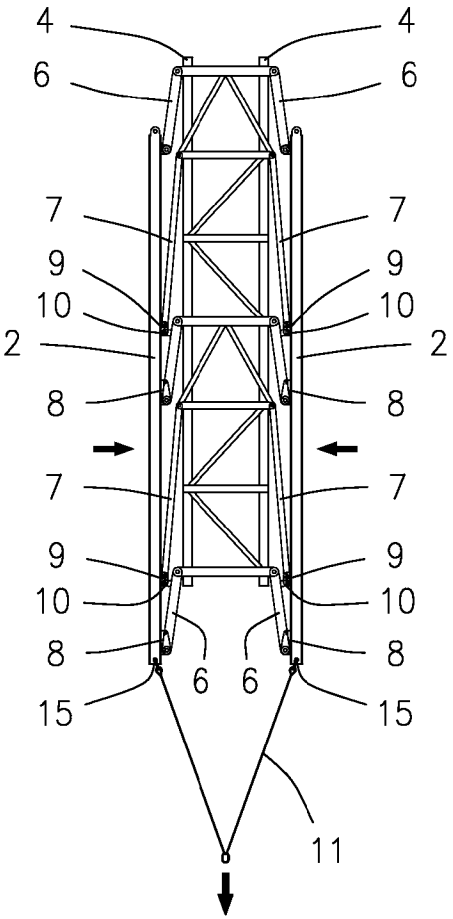
FIG. 6C

ARTICULATING MAST

BACKGROUND OF THE INVENTION

1. Field of the Invention

This invention relates generally to an articulating mast that may be transported from one well drilling site to another, and more particularly to a folding mast wherein sections of the mast may be moved from an open, in-use position to a reduced width configuration for storage and transportation and then moved from the reduced width configuration to an open position for use.

2. Description of the Related Art

In oil and gas operations, well drilling rigs are utilized to drill for reserves. Many times, drilling does not result in a productive well. Other times, a producing well will be exhausted. It has been estimated that over two million boreholes have been dug worldwide.

Masts or derricks are well known for use in oil and gas and other drilling operations. A mast or derrick of a drilling rig supports a vertically moving block and tackle in order to raise and lower drill pipes. A mast may extend up to 200 feet and is usually comprised of structural steel framework, which supports a crown assembly. The crown assembly is an arrangement of sheaves at the top of the mast or derrick directly above the well bore. Various drilling structure arrangements are known, although one arrangement includes a pair of sides with a back face joining the sides and an open front face. A mast is typically braced on three sides with an open front face to receive pipe sections.

Once a drilling project has been completed, moving the drilling rig from one location to another is required. In one known arrangement, the entire drilling rig is disassembled piece by piece, then transported to the next location, and then reassembled.

As a technological advance on the complete disassembly and reassembly of the mast, a folding gin pole arrangement was developed, wherein the mast was lowered to the ground and disassembled. Normally, the mast sections are transported by trailer. Disassembly of the sections is normally required due to roadway limits as to height and width. For example, certain highway regulations limit the width of the load to twelve feet.

As a further technological advance on the folding gin pole arrangement wherein the mast had to be disassembled to fit onto trailers, an articulating mast was developed. This articulating mast is described in Assignee's patent, Brittain et al., U.S. Pat. No. 6,594,960. The mast therein had an articulating back face, such that the mast sections could be folded to a width acceptable for roadway requirements. Disassembly of each section required only the removal of six pins prior to folding, and assembly required only the insertion of six pens following unfolding. One drawback to the Brittain et al. articulating mast is that any guide track system, top drive, and/or traveling block used on the mast must be removed from the mast prior to disassembly, and reinstalled after assembly.

Based on the foregoing, it would be desirable to provide a mast that may be divided into sections that may be folded to meet roadway requirements for weight, width, and height. Furthermore, it would be advantageous to provide a mast wherein sections may be folded to a width acceptable for roadway requirements.

It would further be desirable to provide a mast having sections that may be moved between an open, in-use position and a more compact reduced width configuration for storage and transportation. It would further be desirable to provide a mast having sections that may be locked in either an open, in-use position or a reduced width, transport or storage configuration.

It would further be desirable to provide an articulating mast wherein the required disassembly and subsequent reassembly time is reduced.

It would further be desirable to provide an articulating mast wherein a guide track system, top drive, and/or traveling block may remain in place on the mast during disassembly, transport, storage, and reassembly.

SUMMARY OF THE INVENTION

In general, in a first aspect, the present invention relates to an articulating mast comprising: an open face; a pair of opposed sides, each side having a front leg and a rear leg; a back face extending between the rear legs; a pair of back face vertical supports running parallel to each other; a plurality of back face horizontal supports, each horizontal support having a first and second opposed end, each horizontal support first end pivotally attached to one back face vertical support and each horizontal support second end pivotally attached to one rear leg; a plurality of back face diagonal supports, each diagonal support having a first and second opposed end, each diagonal support first end pivotally attached to one back face vertical support adjacent one horizontal support first end; a plurality of pins; and a plurality of pin receivers on the rear legs adjacent the horizontal support second ends, such that each diagonal support second end may be attached to one rear leg by inserting one pin through the diagonal support second end and one pin receiver.

The articulating mast may be folded from an open position to a closed position by removing the plurality of pins from the plurality of diagonal support second ends and pin receivers to allow the diagonal support first ends, the horizontal support first ends, and the horizontal support second ends to pivot such that the plurality of back face horizontal supports and the plurality of back face diagonal supports move within a plane defined by the back face to lie relatively closer to the back face vertical supports, such that, when the articulating mast is in the closed position, the rear legs remain parallel to the back face vertical supports and within the plane defined by the back face, but are located relatively closer to the back face vertical supports and vertically offset from their location when in the open position.

The articulating mast may further comprise a plurality of pin receivers on the rear legs located such that each diagonal support second end may be secured with one pin to one pin receiver when the articulating mast is in the closed position. Furthermore, transport locks may be located on the horizontal supports such that the transport locks may be pinned to the rear legs when the articulating mast is in a closed position such that the articulating mast cannot easily accidentally unfold during transport.

The articulating mast may further comprise an integral guide track system, a top drive mounted on the integral guide track system, and a traveling block mounted on the integral guide track system. The top drive and the traveling block may be secured when the articulating mast is in the closed position such that they may not travel along the integral guide track system during transport.

The articulating mast may comprise a plurality of vertical sections and connectors between such sections, such that such sections may be disconnected from adjacent sections prior to folding or unfolding the articulating mast.

The articulating mast may be folded by removing the plurality of pins from the plurality of pin receivers and diagonal support second ends and pulling the rear legs downward such that the horizontal support first ends, horizontal support second ends, and diagonal support first ends pivot such that the horizontal supports and diagonal supports move within a plane defined by the back face to lie relatively closer to the back face vertical supports, while the rear legs remain parallel to the back face vertical supports and within the plane defined by the back face but are located relatively closer to the back face vertical supports and are vertically offset from their prior position. The method may further comprise separating the articulating mast into sections prior to removing the plurality of pins from the plurality of pin receivers and diagonal support second ends. If the articulating mast further comprises transport locks located on said horizontal support second ends and a plurality of pin receivers on said rear legs vertically offset from said horizontal support second ends, such that each said diagonal support second end and each transport lock may be attached to one said rear leg by inserting one said pin through said diagonal support second end, said transport lock, and one said pin receiver, the method may further comprise pinning the diagonal support second ends and transport locks to the pin receivers to secure the articulating mast from unfolding. If the articulating mast further comprises an integral guide track system, a top drive, and a traveling block, the method may further comprise securing the top drive and traveling block to the back face prior to removing the plurality of pins from the plurality of pin receivers and diagonal support second ends.

The articulating mast may be unfolded by removing the pins from the diagonal support second ends, transport locks, and pin receivers; and pulling the rear legs upwards such that the horizontal support first ends, horizontal support second ends, and diagonal support first ends pivot such that the horizontal supports and diagonal supports move within a plane defined by the back face to lie relatively further from the back face vertical supports, while the rear legs remain parallel to the back face vertical supports and within the plane defined by the back face but are located relatively further from the back face vertical supports, and such that the horizontal supports lie generally perpendicular to the back face vertical supports. The method may further comprise pinning the diagonal support second ends to the rear legs. If the articulating mast further comprises an integral guide track system, a top drive, and a traveling block, the method may further comprise releasing the top drive and traveling block from the back face after pinning the diagonal support second ends to the rear legs.

BRIEF DESCRIPTION OF THE DRAWINGS

FIGS. 6A, 6B, and 6C are a series of rear views of a section of an articulating mast being folded;

Other advantages and features will be apparent from the following description and from the claims.

DETAILED DESCRIPTION OF THE PREFERRED EMBODIMENTS

The devices and methods discussed herein are merely illustrative of specific manners in which to make and use this invention and are not to be interpreted as limiting in scope.

While the devices and methods have been described with a certain degree of particularity, it is to be noted that many modifications may be made in the details of the construction and the arrangement of the devices and components without departing from the spirit and scope of this disclosure. It is understood that the devices and methods are not limited to the embodiments set forth herein for purposes of exemplification.

Figure 1:
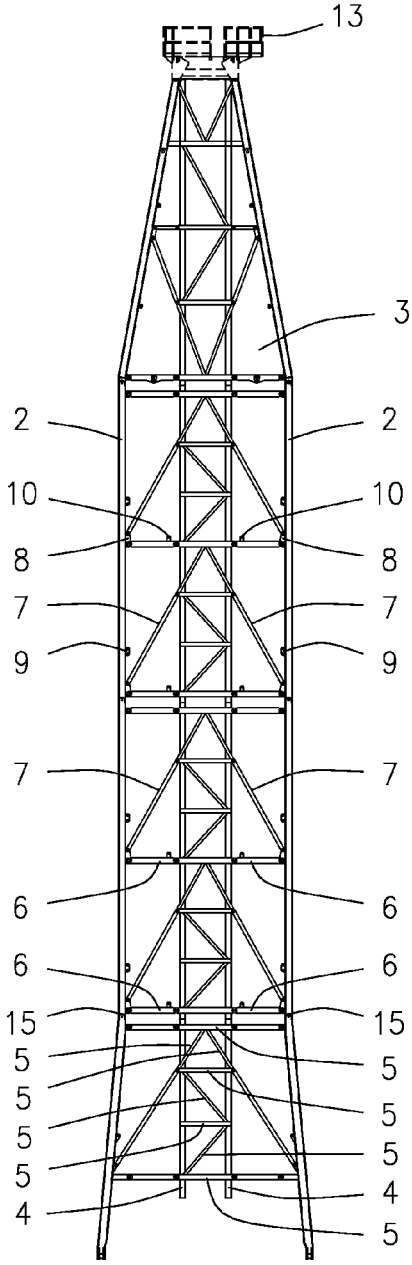
FIG. 1 is a rear view of a fully assembled articulating mast.
Figure 2:
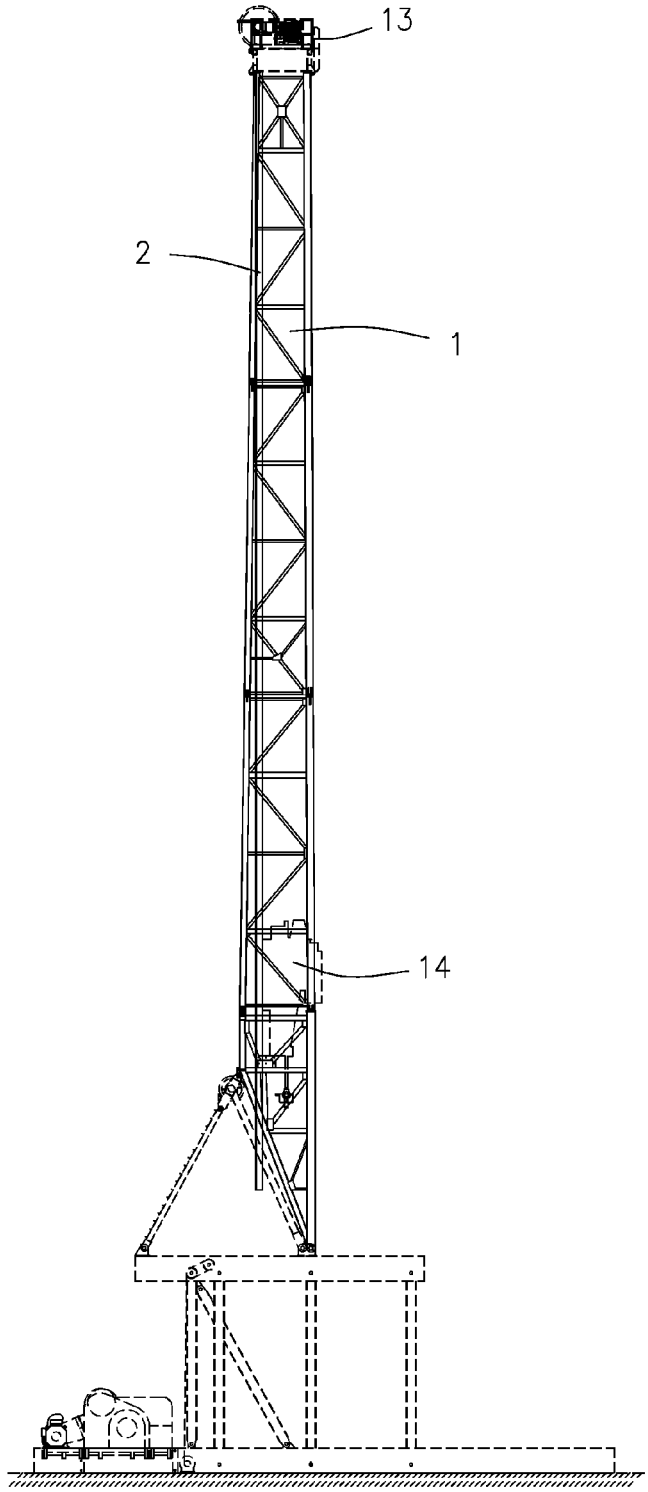
FIG. 2 is a side view of a fully assembled articulating mast.
Figure 3:
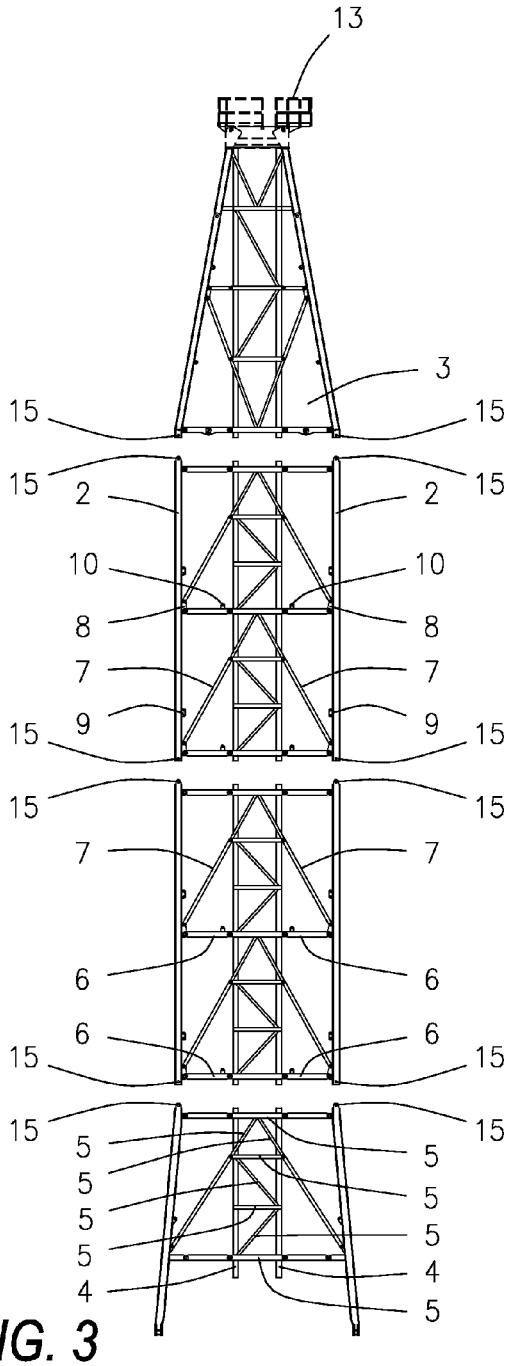
FIG. 3 is a rear view of an articulating mast separated into sections.
Figure 4:
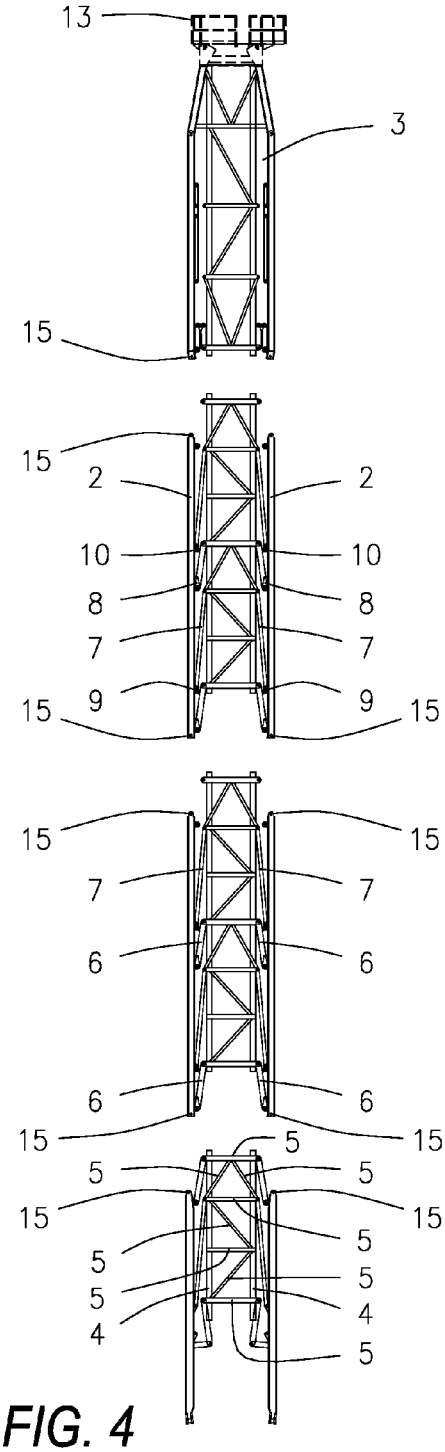
FIG. 4 is a rear view of an articulating mast separated into sections and folded for transportation or storage.

Referring to the figures of the drawings, wherein like numerals of reference designate like elements throughout the several views, FIGS. 1 and 2 show an articulating mast that is fully assembled. FIG. 1 shows the articulating mast from the rear and FIG. 2 shows the articulating mast from the side. The articulating mast shown in the figures is made up of four sections, although any number of sections may be utilized depending on the desired height of the articulating mast. The sections may be attached to each other via connectors 15. FIGS. 3 and 4 show the articulating mast broken into sections, with FIG. 3 showing the articulating mast in an open position ready for use and FIG. 4 showing the articulating mast in a closed position, ready for transportation or storage.

Each section of the articulating mast has a pair of opposed sides 1, each with a front leg and a rear leg 2, and a back face 3 extending between the two rear legs 2. The sides 1 and the back face 3 may be at right angles to each other, such that they form three sides of a rectangle with the fourth side open. The back face 3 may have a pair of back face vertical supports 4 running parallel to each other and to the rear legs 2. The back face vertical supports 4 may be a guide track. The back face 3 may have a plurality of supports 5 attached to and extending between the back face vertical supports 4 in any desired configuration. Each section of the articulating mast may have a plurality of back face horizontal supports 6. Each back face horizontal support 6 may be pivotally attached on one end to one of the back face vertical supports 4 and pivotally attached on the other end to one of the rear legs 2. Each section of the articulating mast may also have a plurality of back face diagonal supports 7, where one end of each back face diagonal support 7 is pivotally attached to one of the back face vertical supports 4 adjacent one of the back face horizontal supports 6.

The rear legs 2 may have a plurality of pin receivers 8 adjacent the back face horizontal supports 6. The end of each back face diagonal support 7 that is not pivotally attached to one of the back face vertical supports 4 may attach to one of the rear legs 2 by inserting one of a plurality of pins through the end of the back face diagonal support 7 and one of the pin receivers 8. Each back face diagonal support 7 may angle downward from the back face vertical support 4 to the rear leg 2, such that the end pivotally attached to the back face vertical support 4 is located adjacent a back face horizontal support 6 at a higher level than the back face horizontal support 6 to which the end of the back face diagonal support 7 that is attached via pin receiver 8 to rear leg 2 is adjacent.

The articulating mast may be folded from an open position to a closed position by first removing the plurality of pins from the plurality of pin receivers 8 and back face diagonal supports 7. Next, as seen in FIGS. 6A, 6B, and 6C, where FIG. 6B is a transition stage, the rear legs 2 may be pulled downward such that the ends of the back face diagonal supports 7 that are pivotally attached to the back face vertical supports 4 and both ends of the back face horizontal supports 6 pivot such that the back face horizontal supports 6 and back face diagonal supports 7 all move within a plane defined by the back face 3 to lie relatively closer to the back face vertical supports 4. This allows the rear legs 2 to remain parallel to the back face vertical supports 4 and within the plane defined by the back face 3, but to be located relatively closer to the back face vertical supports 4 and vertically offset from their original position. A bridle line 11 may be used to pull the rear legs 2.

Once the articulating mast is in a closed position, it may be secured by pinning the ends of the back face diagonal supports 7 to a plurality of pin receivers 9 located on the rear legs 2 at a higher position than the pin receivers 8. The mast may be further secured by pinning a plurality of transport locks 10 located on the back face horizontal supports 6 to the pin receivers 9. Securing the back face diagonal supports 7 and the transport locks 10 to the pin receivers 9 prevents the articulating mast from accidentally unfolding during transport.

Figure 5C:
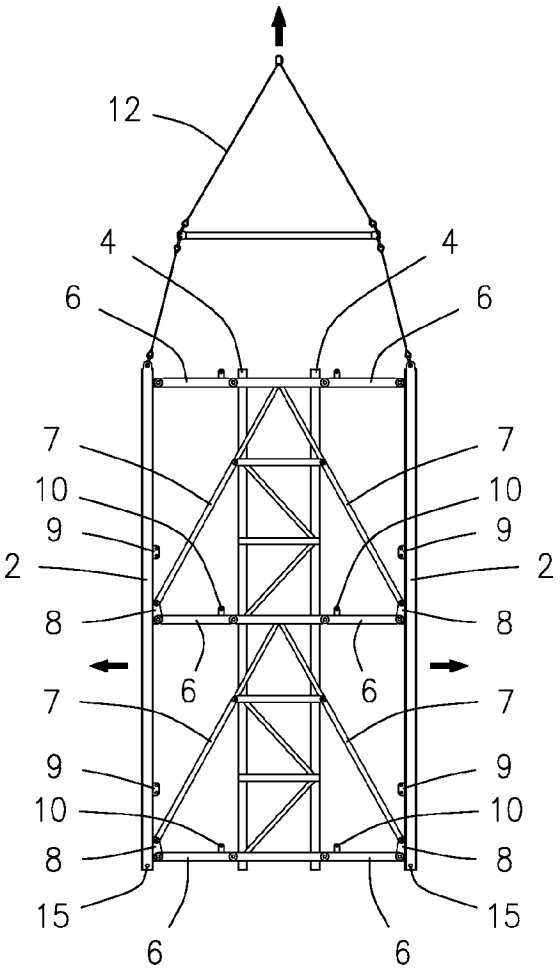
FIGS. 5A, 5B, and 5C are a series of rear views of a section of an articulating mast being unfolded.
Figure 5B:
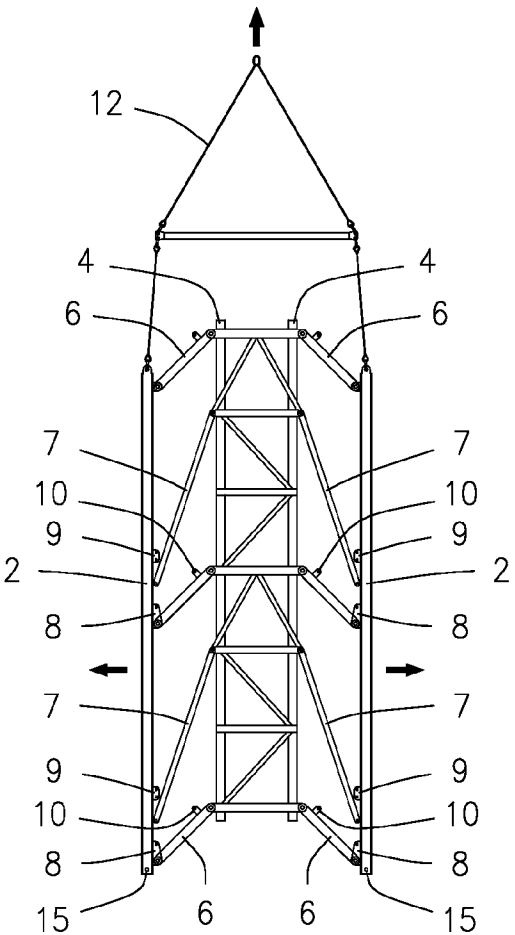
Figure 5A:
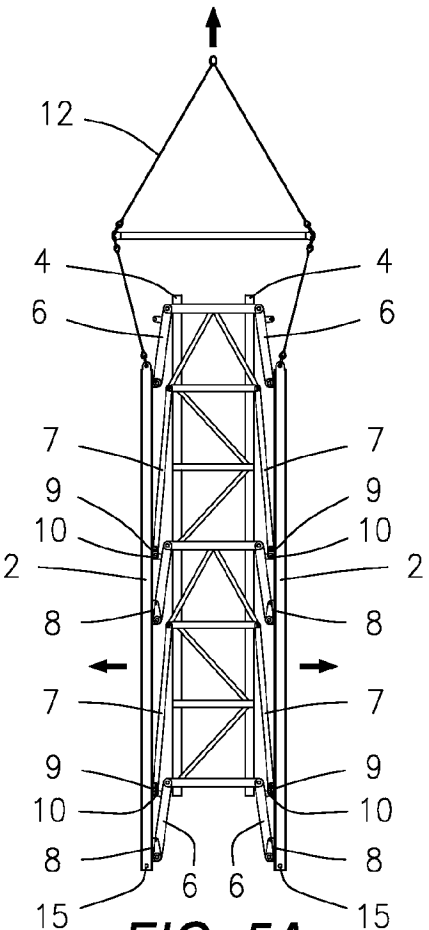

The articulating mast may be folded from a closed position to an open position by first removing the pins from the pin receivers 9, transport locks 10, and back face diagonal supports 7. Next, as seen in FIGS. 5A, 5B, and 5C, where FIG. 5B is a transition stage, the rear legs 2 may be pulled upward such that the ends of the back face diagonal supports 7 that are pivotally attached to the back face vertical supports 4 and both ends of the back face horizontal supports 6 pivot such that the back face horizontal supports 6 and back face diagonal supports 7 all move within a plane defined by the back face 3 relatively further from the back face vertical supports 4. This allows the rear legs 2 to remain parallel to the back face vertical supports 4 and within the plane defined by the back face 3, but to be located relatively further away from the back face vertical supports 4. It also allows the back face horizontal supports 6 to lie generally perpendicular to the back face vertical supports 4. A bridle line with a spreader 12 may be used to pull the rear legs 2. Once the articulating mast is in an open position, it may be secured by pinning the back face diagonal supports 7 to the pin receivers 8.

Figure 7B:
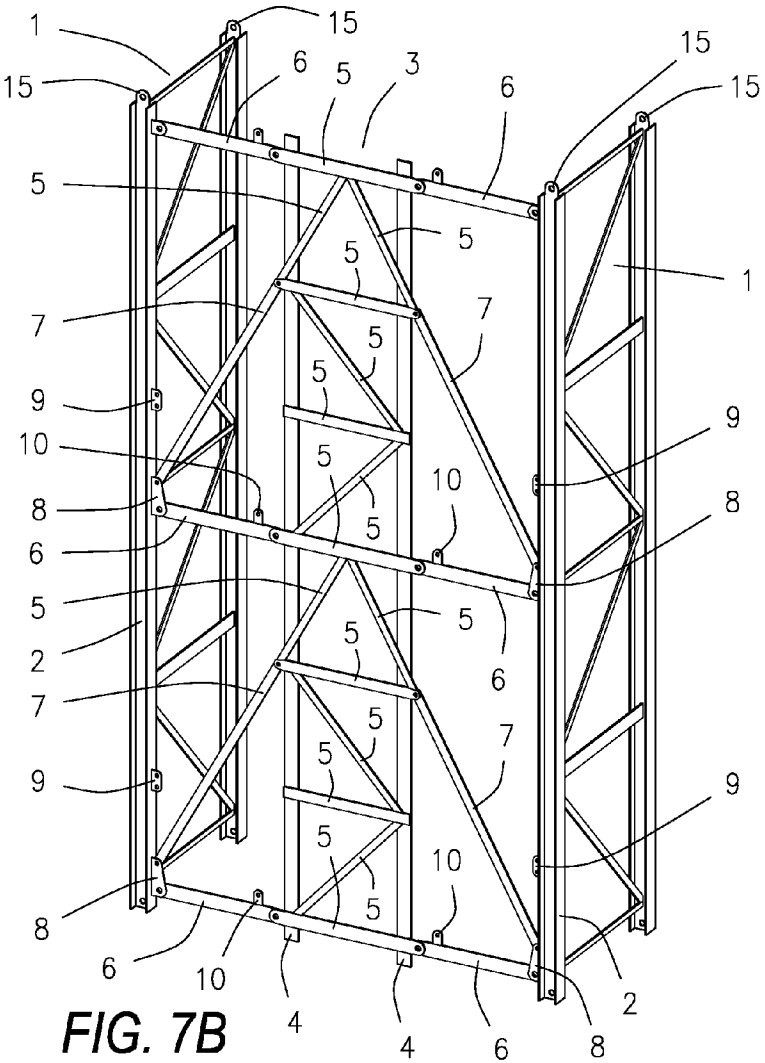
FIG. 7B is a perspective view of a section of an articulated mast in an open, unreduced width configuration.
Figure 7A:
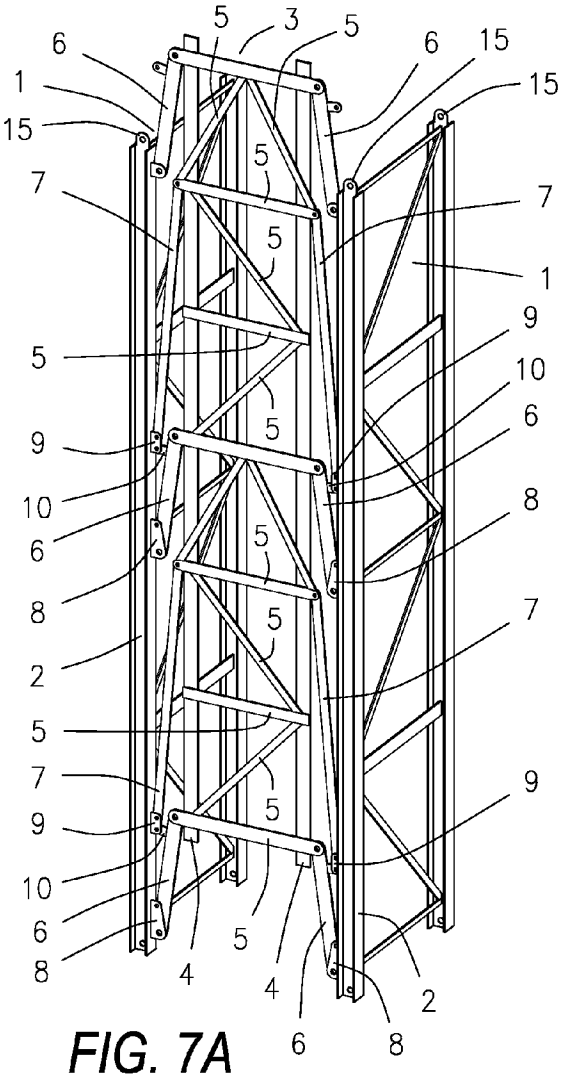
FIG. 7A is a perspective view of a section of an articulated mast in a closed, reduced width configuration.

As can be seen in FIGS. 5, 6, and 7, each of the sections of the articulating mast requires only four pins to secure in either the closed or open position, as opposed to six required in prior art folding masts, thus reducing required labor for disassembly and reassembly. Furthermore, neither the middle of the back face 3 nor the sides 1 are altered by folding the articulating mast, and thus a guide track system, top drive, and/or traveling block may remain in place on the mast during disassembly, transport, storage, and reassembly. A crown assembly 13 may be seen in dashed lines in FIGS. 1 through 4. A guide track system may be integrated into the back face 3, and a top drive and traveling block 14 may be mounted on the integral guide track system, as shown in dashed lines in FIG. 2. The top drive and traveling block 14 may be secured to the back face 3 when the mast is in a closed position so that it does not travel along the integral guide track system during transport.

Whereas, the devices and methods have been described in relation to the drawings and claims, it should be understood that other and further modifications, apart from those shown or suggested herein, may be made within the spirit and scope of this invention.

What is claimed is:

1. An articulating mast, comprising:

an open face;

a pair of opposed sides, each side having a front leg and a rear leg;

a back face extending between said rear legs;

a pair of back face vertical supports running parallel to each other;

a plurality of back face horizontal supports, each said horizontal support having a first and second opposed end, each said horizontal support first end pivotally attached to one said back face vertical support and each said horizontal support second end pivotally attached to one said rear leg;

a plurality of back face diagonal supports, each said diagonal support having a first and second opposed end, each said diagonal support first end pivotally attached to one said back face vertical support adjacent one said horizontal support first end; and a plurality of connecting devices on said rear legs adjacent said horizontal support second ends, such that each said diagonal support second end may be attached to one said rear leg by connecting said diagonal support second end to one said connecting device, such that said articulating mast may be folded from an open position to a closed position by disconnecting said plurality of connecting devices from said plurality of diagonal support second ends to allow said diagonal support first ends, said horizontal support first ends, and said horizontal support second ends to pivot such that said plurality of back face horizontal supports and said plurality of back face diagonal supports move within a plane defined by said back face to lie relatively closer to said back face vertical supports, such that, when the articulating mast is in said closed position, said rear legs remain within the plane defined by the back face, but are located relatively closer to said back face vertical supports and vertically offset from their location when in said open position and two planes each defined by one of the sides remain perpendicular to the plane defined by the back face at all times.

2. The articulating mast of claim 1 where the plurality of connecting devices is a plurality of pin receivers and connecting said diagonal support second end to one said connecting device is accomplished by inserting one of a plurality of pins through said diagonal support second end and one said pin receiver.

3. The articulating mast of claim 2 further comprising a plurality of pin receivers on said rear legs located such that each said diagonal support second end may be secured with one said pin to one said pin receiver when said articulating mast is in said closed position.

4. The articulating mast of claim 3 further comprising a plurality of transport locks located on said horizontal supports such that such transport locks may be pinned to said rear legs when said articulating mast is in a closed position such that said articulating mast cannot easily accidentally unfold during transport.

5. The articulating mast of claim 1 further comprising an integral guide track system.

6. The articulating mast of claim 5 where the guide track is capable of mounting a top drive.

7. The articulating mast of claim 6 where said top drive may be secured when said articulating mast is in said closed position such that said top drive may not travel along said integral guide track system.

8. The articulating mast of claim 5 further comprising a traveling block mounted on said integral guide track system.

9. The articulating mast of claim 8 where said traveling block may be secured when said articulating mast is in said closed position such that it may not travel along said integral guide track system.

10. The articulating mast of claim 1 where said articulating mast comprises a plurality of vertical sections, and further comprising connectors between such sections, such that such sections may be disconnected from adjacent sections prior to folding or unfolding said articulating mast.

11. A method of folding an articulating mast having: an open face; a pair of opposed sides, each side a front leg and a rear leg; a back face extending between said rear legs; a pair of back face vertical supports running parallel to each other; a plurality of back face horizontal supports, each said horizontal support having a first and second opposed end, each said horizontal support first end pivotally attached to one said back face vertical support and each said horizontal support second end pivotally attached to one said rear leg; a plurality of back face diagonal supports, each said diagonal support having a first and second opposed end, each said diagonal support first end pivotally attached to one said back face vertical support adjacent one said horizontal support first end; and a plurality of connecting devices on said rear legs adjacent said horizontal support second ends, such that each said diagonal support second end may be attached to one said rear leg by connecting said diagonal support second end to one said connecting device, said method of folding an articulating mast comprising:

disconnecting said plurality of connecting devices from said plurality of diagonal support second ends; and pulling the rear legs downward such that the horizontal support first ends, horizontal support second ends, and diagonal support first ends pivot such that the horizontal supports and diagonal supports move within a plane defined by the back face to lie relatively closer to the back face vertical supports, while the rear legs remain within the plane defined by the back face but are located relatively closer to the back face vertical supports and are vertically offset from their prior position and two planes each defined by one of the sides remain perpendicular to the plane defined by the back face at all times.

12. The method of claim 11 further comprising separating the articulating mast into sections prior to disconnecting said plurality of connecting devices from said plurality of diagonal support second ends.

13. The method of claim 11, where the plurality of connecting devices is a plurality of pin receivers and disconnecting said plurality of connecting devices from said plurality of diagonal support second ends is accomplished by removing the plurality of pins from the plurality of pin receivers and diagonal support second ends.

14. The method of claim 13, where the articulating mast further comprises a plurality of transport locks located on said horizontal support second ends and a plurality of pin receivers on said rear legs vertically offset from said horizontal support second ends, such that each said diagonal support second end and each transport lock may be attached to one said rear leg by inserting one said pin through said diagonal support second end, said transport lock, and one said pin receiver, and where said method further comprises pinning the diagonal support second ends and transport locks to the pin receivers to secure the articulating mast from unfolding.

15. The method of claim 11 where the articulating mast further comprises an integral guide track system, a top drive, and a traveling block, where the method further comprises securing the top drive and traveling block to the back face prior to disconnecting said plurality of connecting devices from said plurality of diagonal support second ends.

16. A method of unfolding an articulating mast having: an open face; a pair of opposed sides, each side having a front leg and a rear leg; a back face extending between said rear legs; a pair of back face vertical supports running parallel to each other; a plurality of back face horizontal supports, each said horizontal support having a first and second opposed end, each said horizontal support first end pivotally attached to one said back face vertical support and each said horizontal support second end pivotally attached to one said rear leg; a plurality of back face diagonal supports, each said diagonal support having a first and second opposed end, each said diagonal support first end pivotally attached to one said back face vertical support adjacent one said horizontal support first end; a plurality of pins; a plurality of transport locks located on said horizontal support second ends; and a plurality of pin receivers on said rear legs vertically offset from said horizontal support second ends, such that each said diagonal support second end and each transport lock may be attached to one said rear leg by inserting one said pin through said diagonal support second end, said transport lock, and one said pin receiver, said method of unfolding an articulating mast comprising:

removing the pins from the diagonal support second ends, transport locks, and pin receivers; and pulling the rear legs upwards such that the horizontal support first ends, horizontal support second ends, and diagonal support first ends pivot such that the horizontal supports and diagonal supports move within a plane defined by the back face to lie relatively further from the back face vertical supports, while the rear legs remain within the plane defined by the back face but are located relatively further from the back face vertical supports and two planes each defined by one of the sides remain perpendicular to the plane defined by the back face at all times, and such that the horizontal supports lie generally perpendicular to the back face vertical supports.

17. The method of claim 16 where the articulating mast further comprises a plurality of pin receivers on said rear legs adjacent said horizontal support second ends, such that each said diagonal support second end may be attached to one said rear leg by inserting one said pin through said diagonal support second end and one said pin receiver, and where the method further comprises pinning said diagonal support second ends to said rear legs.

18. The method of claim 17 where the articulating mast further comprises an integral guide track system, a top drive, and a traveling block, where the method further comprises releasing the top drive and traveling block from the back face after pinning the diagonal support second ends to said rear legs.

* * * * *